United States Patent [19]

Gotoh

[11] 4,283,748

[45] Aug. 11, 1981

[54] CIRCUIT ARRANGEMENT FOR OPERATING HEAVY-DUTY EQUIPMENT USING ELECTRICAL RELAYING DEVICE

[75] Inventor: Miyuki Gotoh, Tokorozawa, Japan

[73] Assignee: Nissan Motor Company, Limited, Yokohama, Japan

[21] Appl. No.: 20,469

[22] Filed: Mar. 14, 1979

[30] Foreign Application Priority Data

Apr. 12, 1978 [JP] Japan ..... 53-42080

[51] Int. Cl.[3] ..... H01H 47/10

[52] U.S. Cl. ..... 361/154; 361/155

[58] Field of Search ..... 361/154, 155, 194

[56] References Cited

U.S. PATENT DOCUMENTS

| | | | |
|---|---|---|---|
| 1,717,247 | 6/1929 | Perry | 361/154 |
| 2,344,654 | 3/1944 | Stong | 361/194 |
| 2,404,982 | 7/1946 | Owens et al. | 361/155 |
| 2,610,231 | 9/1952 | Wettstein | 361/4 |
| 2,789,253 | 4/1957 | Vang | 361/4 |

FOREIGN PATENT DOCUMENTS

| | | | |
|---|---|---|---|
| 915597 | 11/1946 | France | 361/194 |
| 272012 | 6/1927 | United Kingdom | 361/194 |
| 1199660 | 7/1970 | United Kingdom | 361/194 |

*Primary Examiner*—J. D. Miller
*Assistant Examiner*—L. C. Schroeder
*Attorney, Agent, or Firm*—Lowe, King, Price & Becker

[57] ABSTRACT

A circuit arrangement operates a heavy-duty electrical equipment including an electrical relaying device having a relay coil and a set of first and second relay contacts. The first relay contacts are connected in a circuit that supplies a large amount of current to the electrical equipment. The relay coil is connected to be energized with a small amount of current in response to the closure of a normally open switch and held energized in response to the closure of the second relay contacts. The normally open switch and the second relay contacts form a closed low impedance circuit which supplies an arc current pulse to the second relay contacts during the time when the normally open switch is held closed, whereby fragmentary objects or dust collected between the second contacts is removed as the first and second contacts chatter during a closing.

6 Claims, 4 Drawing Figures

CIRCUIT ARRANGEMENT FOR OPERATING HEAVY-DUTY EQUIPMENT USING ELECTRICAL RELAYING DEVICE

FIELD OF THE INVENTION

The present invention relates to circuit arrangements and methods for operating heavy-duty electrical equipment with a heavy-duty electrical relaying device having some of its relay contacts in heavy current circuits and some contacts in light current circuits requiring a small current magnitude, and in particular to such a circuit arrangement and method in which contact failures are eliminated for the relay contacts in the light current circuits.

BACKGROUND OF THE INVENTION

In a conventional control circuit for operating a heavy-duty electrical equipment such as a three-phase electric motor, a heavy duty type electrical relay such as a contactor, is employed. Some of the relay contacts are connected in power circuits for the motor, while others of the relay contacts are connected in a light or low current circuit that supplies current to the relay coil, to hold the coil in the energized condition. Since a large amount of current passes through the contacts in the heavy duty power circuits, there is resulting chatter of these relay contacts which produces an arc current of a sufficient magnitude to burn out dust or any objects collected between the contacts, thus eliminating contact failures. However, the contacts in the light current circuit carry a small amount of current for the relay coil, so that the resultant arc current is insufficient to burn the objects collected between such contacts.

SUMMARY OF THE INVENTION

In the present invention a large current pulse is supplied across the relay contacts in a small-current circuit. The large current pulse is derived in response to the closure of the contacts to produce arcing between them. Since the relay is of the heavy duty type, its contacts are capable of carrying a large amount of current, so that the generation of the large current does not materially roughen the surface of the relay contacts.

In one embodiment of the invention, the current is controlled by a transformer comprising first and second secondary windings, the first secondary winding being connected to the relay coil through parallel-connected first and second circuits. The first circuit includes the second secondary winding and a normally open switch, which when closed energizes the relay coil. The second circuit includes a pair of relay contacts which hold the relay in the energized condition. when the relay is energized to close its contacts in response to closure of the normally open switch, a short circuit is established across the terminals of the second secondary winding until the normally open switch is open to provide a large current flow through the now closed relay contacts in the relay self-holding circuit.

In a second type of embodiment, energy stored in a capacitor is employed to derive the arc current pulse. The capacitor is connected in either the starting or self-holding circuit to be charged by the current supplied to the winding by the starting or self-holding circuit. A short circuit is established in response to the closure of the relay contacts in the self-holding circuit to rapidly discharge the capacitor to produce arcing.

The primary object of the invention is therefore to provide a circuit arrangement for operating a heavy-duty electrical equipment using a heavy duty type electrical relay which eliminates the occurrence of contact failures in a light current circuit as well as in heavy current circuits.

BRIEF DESCRIPTION OF THE DRAWINGS

The invention will be further described by way of example with reference to the accompanying drawings, in which.

DETAILED DESCRIPTION

Figure 1:
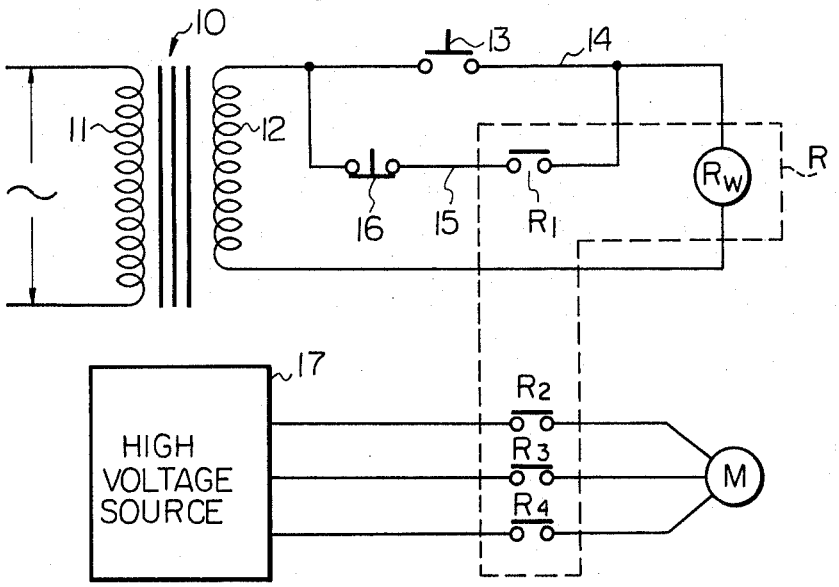
Fig. 1 (PRIOR ART)
FIG. 1 is a circuit diagram of a conventional control circuit.

Before describing the specific embodiments of the present invention, reference is first made to FIG. 1 in which the conventional control circuit arrangement is illustrated. In FIG. 1 an electrical relaying device R of a heavy duty type, such as contactors, is shown as comprising a relay coil Rw which is responsive to an alternating voltage supplied from the secondary winding 12 of a step-down transformer 10, having primary winding 11 connected to an alternating high voltage power source. The relay R includes a set of normally open relay contacts R1, R2, R3 and R4 in pairs, each pair being capable of carrying a current of a magnitude sufficient to operate heavy-duty electrical equipment, such as three-phase electric motor M. A normally open, self-restorable (non-lock type) switch 13 is connected in a starting circuit 14, between one terminal of the secondary winding 12 and one terminal of the relay coil Rw. In parallel with the switch 13 is connected a self-holding circuit 15 including a normally closed, self-restorable switch 16 and the relay contacts R1. The relay contacts R2 to R4 are respectively connected in heavy-current circuits that supply currents from a three-phase high voltage source 17 to a three-phase motor M upon energization of the relay coil Rw. In response to the operation of switch 13, the relay coil Rw is energized, to close relay contacts R1 to R4, so that the motor M is energized and the circuit 15 is completed to supply a current to the relay coil to hold the coil in the energized condition after the switch 13 is open. The relay R is released upon the operation of the switch 16.

At the instant of closure of relay contacts R2 to R4, contact chatter tends to occur in each pair of contacts to produce an arc of a sufficient magnitude to burn out fragmentary objects or dust which might be collected between the contacts. Since the relay R requires a small current magnitude for its operation as compared with the current required by the motor M, the density of current on the surface of contacts R1 is relatively small, so that the resulting arc current is insufficient in magnitude to produce the effect of burning the objects collected between the contacts R1.

Figure 2:
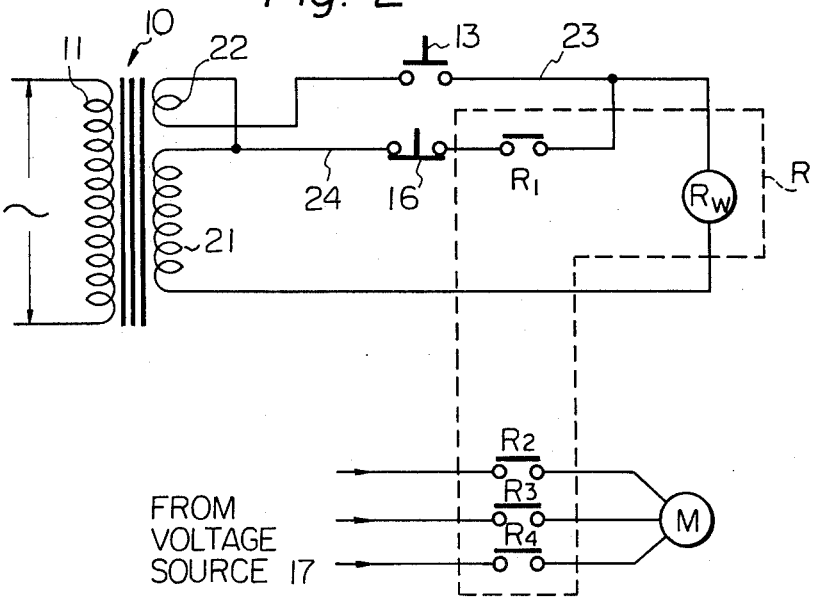
FIG. 2 is a circuit diagram of a first embodiment of the invention.

Referring now to FIG. 2, an embodiment of the present invention is illustrated in which the same numerals are used to indicate the parts similar to those shown in FIG. 1. In FIG. 2, the transformer 10 has a first secondary winding 21 and a second secondary winding 22 having a smaller number of turns than the first secondary winding 21 and connected in series with the first secondary winding 21. The first secondary winding 21 is connected in series with the relay coil Rw through a starting circuit 23 including switch 13 and the second secondary winding 22 to energize the relay coil Rw. The relay holding circuit 24, which includes switch 16 and contacts R1, couples the first secondary winding 21 to the relay winding Rw.

In response to the operation of the normally open switch 13, the starting circuit 23 is completed to energize the relay coil Rw, resulting in the closure of relay contacts R1 to R4 to thereby operate the motor M in the same manner as described above. The self-holding circuit 24 is thus established to hold the relay R in the energized condition, while at the same time establishing a short circuit across the terminals of the second secondary winding 22 until the switch 13 is opened. During the short-circuit condition, a large current flows through the contacts R1. Because of the chatter of contacts R1 there is generated an arc current of a magnitude sufficient to burn out objects which might collect between contacts R1. To derive such arc current, the secondary winding 22 preferably has a relatively large wire gauge. Further it is preferable for the turns of first and second windings 21 and 22 to the connected in the opposite directions. With this connection the current generated by the winding 22 is combined with the current supplied from the winding 21 to thereby increase the amount of arc current.

Figure 3:
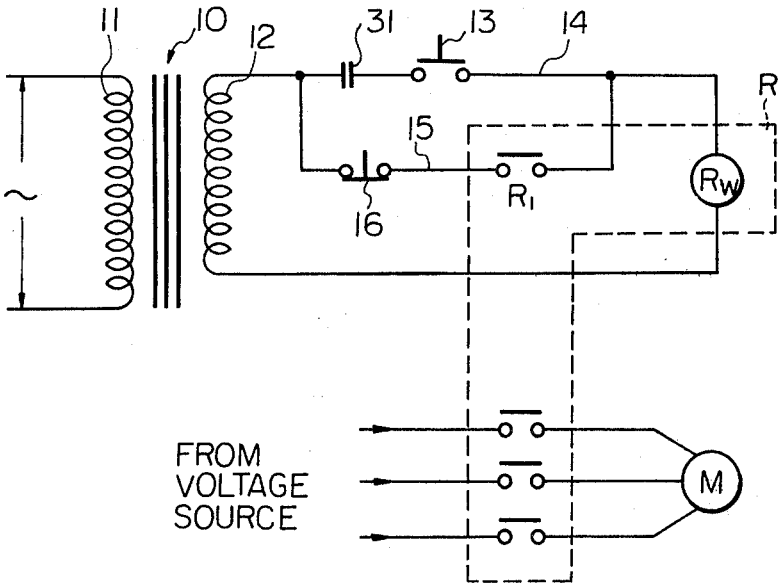
FIG. 3 is a circuit diagram of a second embodiment of the invention.

A second embodiment of the invention illustrated in FIG. 3 is generally similar in circuit configuration to that shown in FIG. 1 with the exception that a capacitor 31 is interposed in the starting circuit 14. The closure of switch 13 supplies a current to the relay coil Rw through the capacitor 31 to operate the relay R, while allowing the capacitor to be charged. The operation of the relay R causes the capacitor 31 to rapidly discharge through switch 16, contacts R1 and switch 13 during the time the latter is held closed. Since the charge stored in capacitor 31 is out of phase with the current carried by the self-holding circuit 15, a large voltage difference develops across the relay contacts R1 and thus produces a large electric arc current to produce the same effect as described above.

Figure 4:
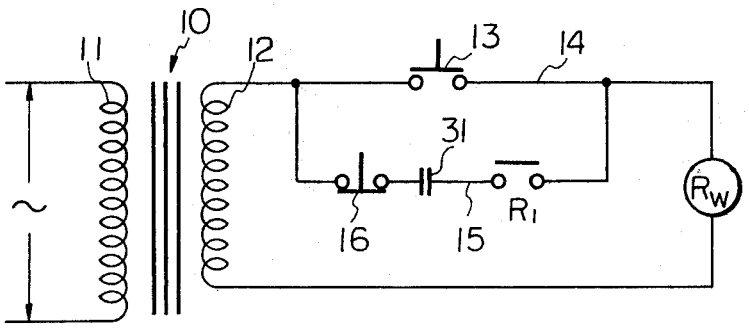
FIG. 4 is a circuit diagram of a modification of the second embodiment.

The embodiment of FIG. 3 is modified as shown in FIG. 4 in which the capacitor is interposed in the self-holding circuit 15. In this modification, repetitive operations of the system tend to build up charge in the capacitor 31; the charge remains stored on capacitor 31 after the opening of the circuit 15. When the relay contacts R1 are closed in a manner identical to that described with reference to FIG. 3, the energy stored in the capacitor 31 is rapidly discharged to produce an arc across the contacts R1 to produce the same effect as described above.

The above embodiments of the present invention can be advantageously employed in applications where equipments separately require large and small magnitudes of operating current. For the invention can be used example, in a shuttleless weaving machine where a rotary cutter is employed to cut off one end of the weft opposite to its insertion side. In this case, the rotary cutter requires a small current magnitude which is usually derived from the same source of power as the weaving machine motor which requires a large magnitude of operating current.

What is claimed is:

1. A circuit arrangment for operating heavy-duty electrical equipment, comprising:

an electrical relay device having a relay coil, first relay contacts connected in a circuit for supplying a large amount of current from a first voltage source to said heavy-duty electrical equipment in response to energization of said relay coil and second relay contacts having the same current-carrying capacity as said first relay contacts;

a normally open switch connected in a circuit for supplying a small amount of current to said relay coil from a second voltage source to energize said coil in response to a closure of the switch, thereby closing said first and second relay contacts;

a holding circuit for supplying a small amount of current through said second relay contacts to said relay coil from said second voltage source for holding said relay coil in the energized condition in response to the closure of said second relay contacts and establishing a low impedance closed circuit through the closed, normally open switch and the closed second relay contacts; and means for supplying a voltage to said closed low impedance circuit and causing a current to pass through said closed second relay contacts with sufficient magnitude to produce an arc that burns out objects which have collected between said second relay contacts.

2. A circuit arrangement as claimed in claim 1, comprising a transformer having primary, first secondary and second secondary windings, said primary winding being connected to be energized by a source of alternating voltage, said first secondary winding connected to said relay coil through parallel-connected first and second circuits, said first circuit including said second secondary winding and said normally open switch and said second circuit including said second relay contacts, said second secondary winding having a smaller number of turns than said first secondary winding.

3. A circuit arrangement as claimed in claim 2, wherein said first and second secondary windings are connected in series in opposite winding directions to each other.

4. A circuit arrangement as claimed in claim 1, comprising a transformer having a primary winding connected to be energized by a source of alternating voltage and a secondary winding connected in series with said relay coil through parallel-connected first and second circuits, the first circuit including said normally open switch and said second circuit including said second relay contacts, and a capacitor connected in one of said first and second circuits.

5. A circuit arrangement as claimed in claim 4, wherein the capacitor is connected only in said first circuit.

6. A circuit arrangement as claimed in claim 4, wherein the capacitor is connected only in said second circuit.

* * * * *